US008099033B2

(12) United States Patent
Cahill

(10) Patent No.: US 8,099,033 B2
(45) Date of Patent: Jan. 17, 2012

(54) PRESSURE ROLLER INTERFRAME OIL CLEANING DEVICE AND METHOD

(75) Inventor: David F. Cahill, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 708 days.

(21) Appl. No.: 12/127,142

(22) Filed: May 27, 2008

(65) Prior Publication Data

US 2009/0297234 A1 Dec. 3, 2009

(51) Int. Cl.
*G03G 15/20* (2006.01)

(52) U.S. Cl. ..... 399/327

(58) Field of Classification Search ..... 399/71, 399/324–327

See application file for complete search history.

(56) References Cited

U.S. PATENT DOCUMENTS

| | | | | |
|---|---|---|---|---|
| 3,983,287 | A | 9/1976 | Goossen et al. | |
| 4,791,275 | A | 12/1988 | Lee et al. | |
| 4,984,027 | A | 1/1991 | Derimiggio et al. | |
| 5,047,809 | A * | 9/1991 | Owada et al. | 399/325 |
| 5,160,970 | A * | 11/1992 | Isogai | 399/325 |
| 5,450,183 | A | 9/1995 | O'Leary | |
| 5,512,729 | A * | 4/1996 | Kusaka et al. | 399/327 |
| 6,243,558 | B1 * | 6/2001 | Oota | 399/326 |
| 6,654,584 | B2 * | 11/2003 | Aslam et al. | 399/326 |
| 6,799,000 | B2 * | 9/2004 | Aslam et al. | |

FOREIGN PATENT DOCUMENTS

| | | |
|---|---|---|
| JP | 04-024678 | 1/1992 |
| JP | 06-075498 | 3/1994 |

* cited by examiner

*Primary Examiner* — David Gray
*Assistant Examiner* — Laura Roth
(74) *Attorney, Agent, or Firm* — Donna P. Suchy

(57) ABSTRACT

A fuser assembly for an electrostatographic reproduction apparatus including a fuser roller, a pressure roller, and a pressure roller cleaner for cleaning the pressure roller. The pressure roller cleaner has an absorbent portion and a drive mechanism for moving the pressure roller cleaner relative to the pressure roller such that the pressure roller cleaner is selectively located proximate the pressure roller to absorb oil. A controller selectively activates the drive mechanism to move the pressure roller cleaner.

21 Claims, 3 Drawing Sheets

PRESSURE ROLLER INTERFRAME OIL CLEANING DEVICE AND METHOD

FIELD OF THE INVENTION

This invention relates in general to electrographic printing, and more particularly to the interframe cleaning of pressure rollers.

BACKGROUND OF THE INVENTION

In typical commercial reproduction apparatus (electrostatographic copier/duplicators, printers, or the like), a latent image charge pattern is formed on a uniformly charged charge-retentive or photoconductive fuser roller having dielectric characteristics (hereinafter referred to as the dielectric support fuser roller). Pigmented marking particles are attracted to the latent image charge pattern to develop such image on the dielectric support fuser roller. A receiver fuser roller, such as a sheet of paper, transparency or other medium, is then brought into contact with the dielectric support fuser roller, and an electric field applied to transfer the marking particle developed image to the receiver from the dielectric support fuser roller. After transfer, the receiver bearing the transferred image is transported away from the dielectric support fuser roller, and the image is fixed (fused) to the receiver by heat and pressure to form a permanent reproduction thereon.

One type of fuser assembly for typical electrographic reproduction apparatus includes at least one heated roller, having an aluminum core and an elastomeric cover layer, and at least one pressure roller in nip relation with the heated roller. The fuser assembly rollers are rotated to transport a receiver, bearing a marking particle image, through the nip between the rollers. The pigmented marking particles of the transferred image on the surface of the receiver soften and become tacky in the heat. Under the pressure, the softened tacky marking particles attach to each other and are partially imbibed into the interstices of the fibers at the surface of the receiver. Accordingly, upon cooling, the marking particle image is permanently fixed to the receiver.

With roller fuser assemblies, it is common practice to use release fluids, such as silicone oil for example, applied to the fuser roller surface to improve the release of image-carrying receivers from the fuser roller. The most common types of release fluid applicators or oilers are a rotating wick roller, a donor/metering roller, an oil impregnated oiling web, oil impregnated oiling pad or roller, or variations or combinations of the above. The release oil applied to the fuser roller tends to migrate from the fuser roller to the opposing pressure roller. This occurs, for example, between receivers passing through the fuser assembly. Oil on the pressure roller can be deposited on subsequent receivers transported through the fuser assembly. This may lead to undesirable, deleterious artifacts on the copies being reproduced, such that the copies are degraded to the extent that makes them unacceptable for intended use.

The fusing step in a roller fuser commonly consists of passing the toned receiver between a pair of engaged rollers that produce an area of pressure contact known as a fusing nip. In order to form the fusing nip, at least one of the rollers typically has a compliant or conformable layer on its surface. Heat is transferred from at least one of the rollers to the toner in the fusing nip, causing the toner to partially melt and attach to the receiver. In the case where the fuser roller is a heated roller, a resilient compliant layer having a smooth surface is typically used which is bonded either directly or indirectly to the core of the roller. Where the fuser roller is in the form of a belt, e.g., a flexible endless belt that passes around the heated roller, it typically has a smooth, hardened outer surface.

Most roller fusers, known as simplex fusers, attach toner to only one side of the receiver at a time. In this type of fuser, the roller that contacts the unfused toner is commonly known as the fuser roller and is usually the heated roller. The roller that contacts the other side of the receiver is known as the pressure roller and is usually unheated. Either or both rollers can have a compliant layer on or near the surface. In most fusing stations having a fuser roller and an engaged pressure roller, it is common for only one of the two rollers to be driven rotatably by an external source. The other roller is then driven rotatably by frictional contact.

In a duplex fusing station, which is less common, two toner images are simultaneously attached, one to each side of a receiver passing through a fusing nip. In such a duplex fusing station there is no real distinction between fuser roller and pressure roller, both rollers performing similar functions, i.e., providing heat and pressure.

Two basic types of simplex heated roller fusers have evolved. One uses a conformable or compliant pressure roller to form the fusing nip against a hard fuser roller, such as in a DocuTech 135 machine made by the Xerox Corporation. The other uses a compliant fuser roller to form the nip against a hard or relatively non-conformable pressure roller, such as in a Digimaster 9110 machine made by the Eastman Kodak Company. A fuser roller designated herein as compliant typically includes a conformable layer having a thickness greater than about 2 mm and in some cases exceeding 25 mm. A fuser roller designated herein as hard includes a rigid cylinder, which may have a relatively thin polymeric or conformable elastomeric coating, typically less than about 1.25 mm thick. A compliant fuser roller used in conjunction with a hard pressure roller tends to provide easier release of a receiver from the heated fuser roller, because the distorted shape of the compliant surface in the nip tends to bend the receiver towards the relatively non-conformable pressure roller and away from the much more conformable fuser roller.

A conventional toner fuser roller includes a cylindrical core, often metallic such as aluminum, coated with one or more synthetic layers, which typically include polymeric materials made from elastomers. Some fusing assemblies also includes a release fluid application subassembly that applies release fluid, such as, for example, silicone oil, to fusing roller. The release fluid substantially prevents toner particles from sticking to the fuser roller.

One common type of fuser roller is internally heated, i.e., a source of heat for fusing is provided within the roller for fusing. Such a fuser roller normally has a hollow core, inside of which is located a heating source, usually a lamp. Surrounding the core is an elastomeric layer through which heat is conducted from the core to the surface, and the elastomeric layer typically contains fillers for enhanced thermal conductivity. A different kind of fuser roller, which is internally heated near its surface, is disclosed by Lee et al. in U.S. Pat. No. 4,791,275, which describes a fuser roller including two polyimide Kapton® sheets (sold by DuPont.®. and Nemours) having a flexible ohmic heating element disposed between the sheets. The polyimide sheets surround a conformable polyimide foam layer attached to a core. According to J. H. DuBois and F. W. John, Eds., in Plastics, 5th Edition, Van Nostrand and Rheinhold, 1974, polyimide at room temperature is fairly stiff with a Young's modulus of about 3.5 GPa-5.5 GPa (1 GPa=1 GigaPascal=10.sup.9 Newton/m.sup.2), but the Young's modulus of the polyimide sheets can be expected to be considerably lower at the stated high operational fusing temperature of the roller of at least 450 degrees F. Alternately an externally heated fuser roller may be used, for example, in an Image Source 120 copier, and can be heated by surface contact between the fuser roller and one or more external heating rollers or other means. Externally heated fuser rollers are also disclosed by O'Leary, U.S. Pat. No. 5,450,183, and by Derimiggio et al., U.S. Pat. No. 4,984,027.

The fixing quality of toned images of an electrophotographic printer depends on the temperature, nip-width, process speed, and thermal properties of the fusing roller, toner chemistry, toner coverage, and receiver type. To simplify the engineering and control of a roller fusing system, as many as possible of the above parameters are considered and then fixed during the system's design. The fusing parameters such as temperature, nip-width, process speed, and thermal properties of the fusing roller are optimized for the most critical case.

Complicating the system's design is the fact that the toner coverage and the receiver type (weight, coated/uncoated) can vary from image to image in a digital printer. Therefore, some of the above listed parameters need to be adjusted according to the image contents and the receiver types to assure adequate image fixing. Typically, the fuser temperature is adjusted and kept constant for a dedicated run with a particular receiver. The temperature is adjusted higher from the nominal for heavier receivers and lower for lighter receivers. For some heavy receivers, the speed must also be reduced.

In the standard fusing system the pressure roller and/or the interframe area can become contaminated with oil and this causes problems with image quality. One way this occurs is due to the application of the release fluid, such as, for example, silicone oil, to fusing roller to prevent toner particles from sticking to the fuser roller. If there is excess oil then some remains in the interframe areas between sheets of receivers and cause artifacts on the next printed receivers. In order to reduce image artifacts which are attributable to and/or are the result of release fluid disposed upon and/or impregnating a receiver that is subsequently processed by/through another device such as a glossing assembly there is the need for a interframe cleaning device.

SUMMARY OF THE INVENTION

The invention uses a cleaning roller to prevent the deposition of artifacts due to interframe oil deposition or other sources. The invention uses the cleaning device for cleaning the pressure roller in an electrophotographic printing machine using a compliant cleaner roller pressed against the pressure roller surface to reduce to an undetectable level any interframe oil band deposits.

According to this invention there is provided a fuser for an electrostatographic reproduction apparatus including a fuser roller, a pressure roller, and a pressure roller cleaner for cleaning the pressure roller. The pressure roller cleaner has an absorbent portion and a drive mechanism for moving the pressure roller cleaner relative to the pressure roller such that the pressure roller cleaner is selectively located proximate the pressure roller to absorb oil. The controller selectively activates the drive mechanism to move the pressure roller cleaner. The pressure roller cleaner has one or more oil absorbing layers adapted to absorb oil. The drive mechanism associated with the cleaner moves the cleaner relative to the pressure roller such that the cleaner is located in operative association with the pressure roller, or located in spaced relation remote from the pressure roller. A logic and control unit selectively activates the drive mechanism to move the cleaner to the operative association location or the remote location.

BRIEF DESCRIPTION OF THE DRAWINGS

In the detailed description of the preferred embodiment of the invention presented below, reference is made to the accompanying drawings.

DETAILED DESCRIPTION OF THE INVENTION

Figure 1:
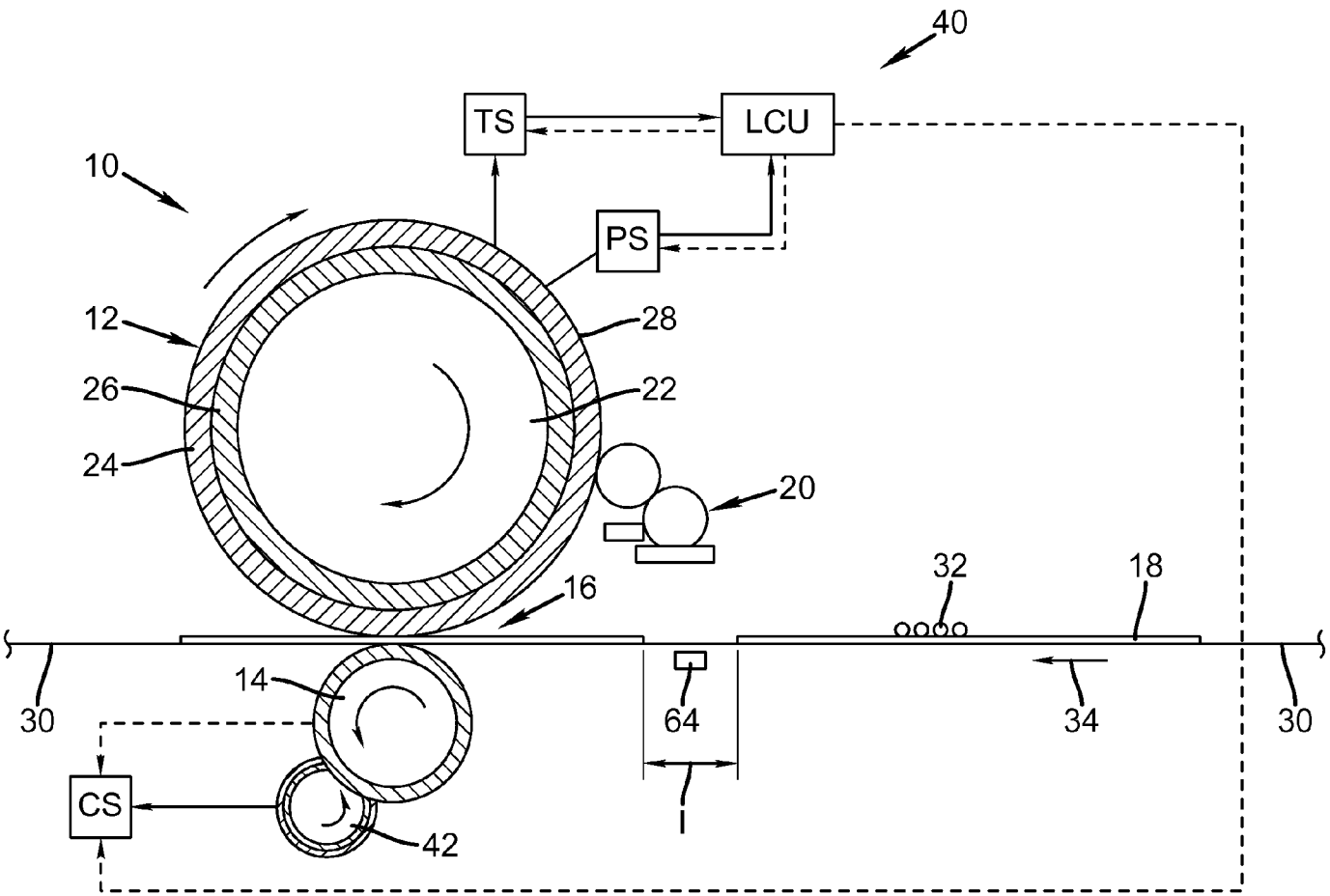
FIG. 1 shows a schematic side elevational view of an electrostatographic reproduction apparatus fusing assembly including an oiler mechanism and a pressure roller cleaning mechanism according to this invention.

A schematic sketch of the fuser assembly of an electrophotographic printer (EP), including the cleaning device, is disclosed in this invention is shown in FIG. 1. The fuser assembly 10 includes a fusing roller 12 and a pressure roller 14. The fusing roller 12, including at least one heated roller, and opposing pressure roller 16 form a fusing nip 16 there between. The fusing roller 12 is heated to a higher temperature, in one embodiment to around 120 degree Celsius, but there is also a need to adjust the fuser roller's temperature as needed above and/or below this illustrative temperature depending on a number of factors including paper type, toner and image characteristics to name only a few factors known in the art. The receiver (sheet) 18 release from the fusing rollers 12 and 14, is accomplished by a pair of air knives (not shown), including an air skive that can force cooling air towards the nip or in alternative embodiments mechanical pawls or skive fingers for example, are utilized for receiver stripping, replacing the air knives. Toner offset prevention is accomplished by application of a release fluid 20 to the fusing roller(s). The release fluid application subassembly generally designated 20 applies release fluid, such as, for example, silicone oil, to fusing roller 12. The release fluid substantially prevents toner particles from sticking to the fuser roller 12. The release fluid applicator is shown in the diagram as a donor roller type but could be a web type applicator or other such device.

The fusing roller 12 includes an aluminum core 22, an elastomeric base-cushion 24 (relatively more compliant than the pressure roller), a conductive elastomeric intermediate layer 26 (to 125 mils thick depending on the process speed), and finally a thin (1-2 mil) top release coating 28. Also shown is a transport belt 30 that serially transports the toner image carrying receivers 18 to a fusing or fixing assembly, which fixes or at least tacks the toner particles to the receiver by the application of heat and pressure.

The receiver 18 carrying the fused image (or at least tacked image) 32 is transported from the fusing assembly along a path 34 to either a remote output tray (not shown) when no clear toner overcoat is to be employed or to another assembly such as a glossing assembly (not shown) if a clear toner overcoat is to be provided.

The release oil device for the fuser assembly is designated generally by the numeral 20. The release oil device 20 is illustrated as being of the donor roller type, but any other suitable system may be employed. The release oil device 20 delivers release oil to the surface of the fusing fuser roller 12 to substantially prevent offset of marking particles from a marking particle-developed image to the fusing fuser roller 12 during the process of fusing of such marking particle image to a receiver fuser roller.

The heated fusing roller 12 for fusing the toner to sheets of receiver media 18 and the pressure roller 14 that forms a nip 16 with the fusing fuser roller is in communication with a machine controller 40 for changing fusing nip widths in accordance with the type of receiver media and the image on the media.

Figure 2:
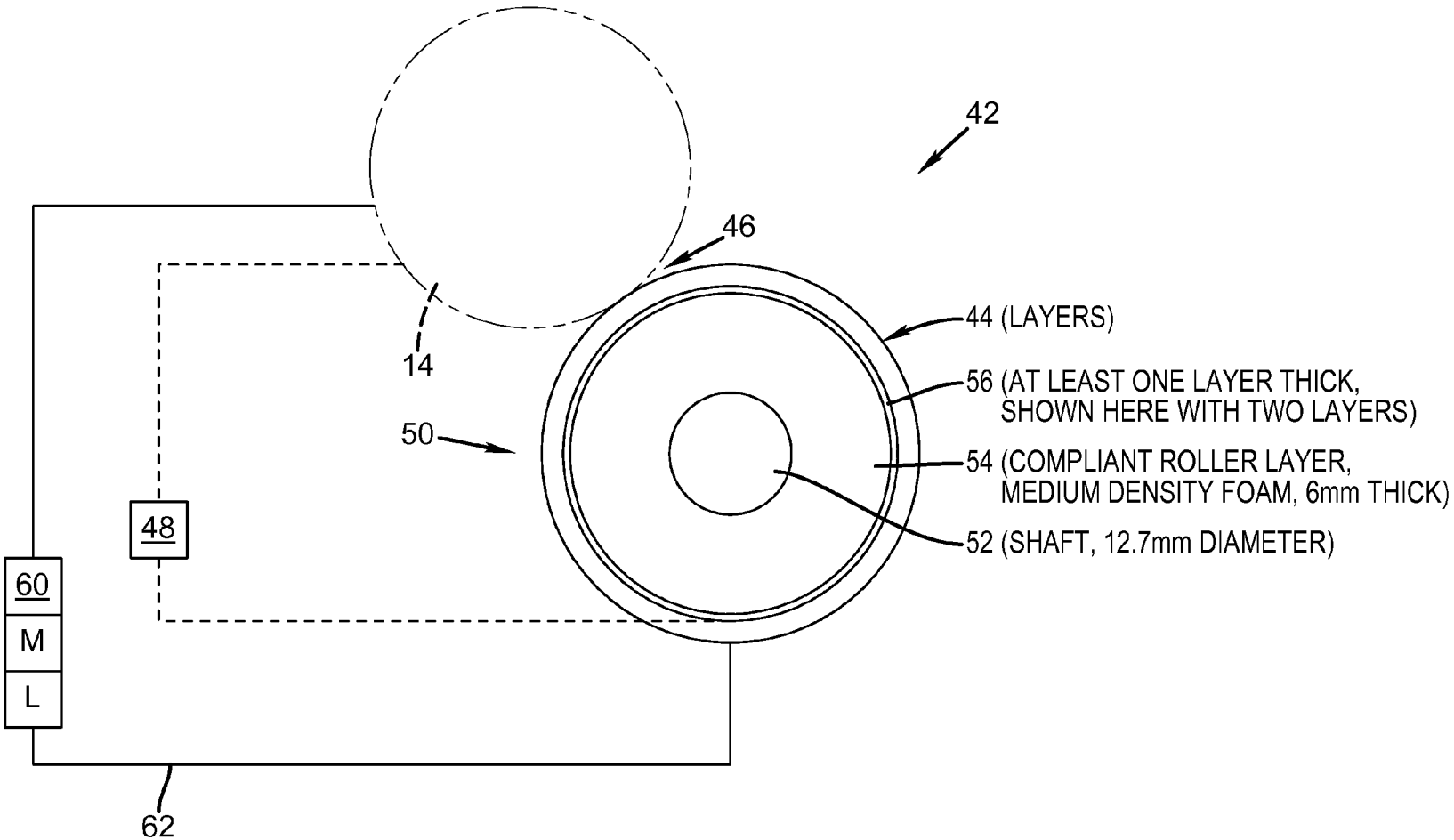
FIG. 2 shows a schematic side elevation view of the cleaning roller of the pressure cleaning mechanism of FIG. 1, partly in cross-section with portions removed to facilitate viewing, including a device for selectively moving the cleaning roller relative to the fuser assembly pressure roller.

A pressure roller cleaner 42 is shown in FIG. 2 for cleaning the pressure roller surface as represented in FIG. 1. The pressure roller cleaner has one or more oil absorbent layers 44 that are in intermittent contact with the pressure roller 14 forming a cleaning nip 46 between the pressure roller cleaner and the pressure roller 14 as shown. An optional pressure roller-cleaner roller nip controller 48 associated with the machine controller 40 controls the cleaner functionality including nip width between the pressure roller 14 and the pressure roller cleaner 42. The pressure roller cleaner 42 removes any residual marking prevents undesirable image artifacts, caused by residual oil used in the reproduction process.

In one embodiment an additional reduction in interframe artifact level can be achieved by using a compliant roller as the support layer for the absorbent material. An example of such an oil absorbing material is the BMP of America OTH002 material consisting of 70% PES (polyethersulfone) and 30% PA Nylon (Polyamides). The thickness range for the absorbent material is typically between 0.200 mm and 0.450 mm but could actually compose the whole roller in one embodiment. Other oil absorbent materials can be used such as polyester and polyester/Nomex blends. Some materials such as 100% Nomex materials and Teflon coated materials do not spread the interframe oil well as they are less oil absorbing so these are not as useful.

The fuser assembly, designated generally by the numeral 10, has a fusing fuser roller 12 in the form of a roller, although a belt, sleeve, or any other variation thereof would be applicable with this invention. The fusing fuser roller 12 is heated by a suitable heating mechanism (not shown), and is located in nip relation with a pressure roller 14. The pressure roller 14 is also shown as being in the form of a roller, and may similarly be a belt, sleeve, or any other variation thereof The fusing nip between the fusing fuser roller 12 and the pressure roller 14 is associated with the receiver travel path of the reproduction apparatus. That is, as a receiver bearing a marking particle image is transported along the travel path with the nip between the fuser and the pressure rollers 12, 14, the marking particle image is fixed to the receiver fuser roller by application of heat and pressure in the fusing nip before the receiver fuser roller is delivered from the travel path to an output device or a duplex reproduction recirculation path.

With the fuser assembly 10 of this embodiment, the fuser roller 12 and the pressure roller 14 are internally heated. As noted, the release oil device 20 serves to apply release oil to the fusing fuser roller 12 to substantially prevent any marking particle offset onto the fusing fuser roller 12. The pressure roller 14 also receives some residual release oil, which migrates from the fusing fuser roller 12, or other places, during the interframe between successive receiver fuser rollers 18, as shown in FIG. 1, having marking particle images respectively being fused thereto. It has been known that during fusing of duplex (two-sided) reproductions, the side of the receiver fuser roller bearing the marking particle image that comes in contact with the pressure roller 14 may tend to show some image artifacts due to such residual release oil transferred to the pressure roller 14. Also some of the residual release oil may be carried out of the fuser assembly 10 by the fused receiver fuser roller to potentially contaminate other elements of the reproduction apparatus. Accordingly, the residual release oil from the pressure roller 14 needs to be removed, or smoothed out, before the receiver fuser roller bearing the marking particle image comes in contact with the pressure roller 14. In prior electrostatographic reproduction apparatus, cleaning webs for the pressure rollers have been used.

According to this invention, the interframe cleaning device, designated generally by the numeral 42, includes a cleaning roller 50 having a substantially rigid steel or aluminum core 52. The core 52 is surrounded by a compliant layer 54 covered with one or more layers of an oil absorbing material 56 (see FIG. 2). The oil absorbing material 56 is preferably, for example, high strength non-woven polyester, or non-woven polyester coated with PTFE. The oil absorbing material 56 can also be a renewable sheet in the form of a single sheet, or a plurality of single sheet layers located one over another. Alternatively the compliant layer 54 of the cleaning roller SO can be one or more layer of a bonded or manufactured in place material. In one embodiment the oil absorbing layers include absorbing materials such as the BMP of America OTH002 material consisting of 70% PES (polyethersulfone) and 30% PA Nylon (Polyamides). The thickness range for the absorbent material is typically between 0.200 mm and 0.450 mm. Other oil absorbent materials can be used such as polyester and polyester/Nomex blends. 100% Nomex materials and Teflon coated materials do not spread the interframe oil well as they are less oil absorbing.

The compliant cleaner roller may include a conformable layer of any useful material, such as for example a substantially incompressible elastomer, i.e., having a Poisson's ratio approaching 0.5. A substantially incompressible conformable layer including a poly(dimethyl siloxane) elastomer has been disclosed by Chen et al., in the commonly assigned U.S. Pat. No. 6,224,978, which is hereby incorporated by reference. Alternatively, the conformable layer may include a relatively compressible foam having a value of Poisson's ratio much lower than 0.5. A conformable polyimide foam layer is disclosed by Lee in U.S. Pat. No. 4,791,275 and a lithographic printing blanket are disclosed by Goosen et al. in U.S. Pat. No. 3,983,287, including a conformable layer containing a vast number of frangible rigid-walled tiny bubbles, which are mechanically ruptured to produce a closed cell foam having a smooth surface.

The cleaning roller 50 of the pressure roller cleaning device 42 serves to clean the pressure roller 14 and by doing so prevent residual release oil induced artifacts on the side of the receiver fuser roller contacting the pressure roller 14. The oil absorbing material 56 of the cleaning roller 50 absorbs the residual release oil from the pressure roller 14 by alternately moving close enough to communicate with the oil and allow absorption to occur.

The method for cleaning a pressure roller in a fusing station of an electrostatographic printer occurs intermittently, as needed, while fusing toner to sheets of receiver media using a heated fuser roller and a pressure roller comprising a pressure roller surface proximate said heated fuser roller to form a fusing nip there between which includes changing fusing nip widths with a machine controller in accordance with the type of receiver media and the image on the media. The cleaning of the pressure roller is accomplished by contacting a cleaner surface portion having one or more oil absorbent layers intermittently with said pressure roller thus forming a cleaning nip there between. Often the need for this cleaning step occurs only during duplex printing since then both sides of the receiver must be oil free.

This cleaning can be enhanced by using pressure to push an array of one or more oil absorbent layers against the pressure roller surface. This involves also varying the pressure roller-cleaner nip width to create a differential nip and possibly a differential pressure between said pressure roller and said cleaner in order to remove oil from said pressure roller. In one embodiment the cleaner surface portion can be pushed against the pressure roller with sufficient force that the cleaning surface portion is deflected at least 0.200 mm when the cleaner surface portion has oil absorbent layers with a thickness range between 0.200 mm and 0.450 mm. A separate cleaner roller controlled can control these movements and be in communication with the machine controller in order to vary the cleaning actions in relation to other printing factors such as speed, toner and receiver type by controlling said pressure roller cleaner based on the results.

Figure 3:
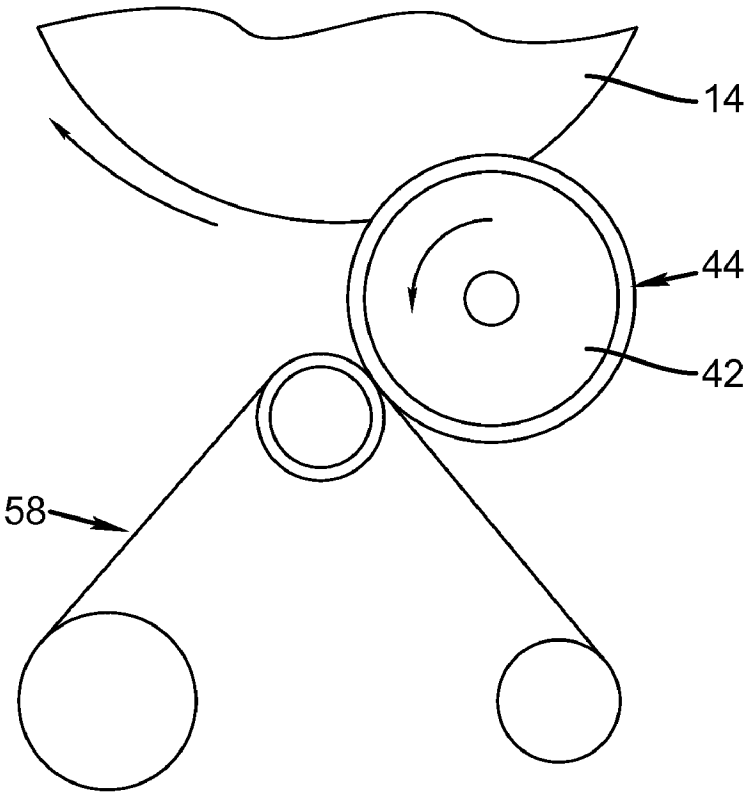
FIG. 3 shows a schematic side elevation view of the cleaning roller of the pressure cleaning mechanism of FIG. 1 with an additional cleaning apparatus.

After a suitable period of use, the sheet oil absorbing layers 44 of the cleaning roller 44 becomes sufficiently contaminated to prevent adequate cleaning of the pressure roller 14. At that time, the top layers 44 are replaced with new layers, or themselves cleaned by another method or device 58, such as the one shown in FIG. 3.

An actuating mechanism 60 serves to bring the cleaning roller 42 into contact with the pressure roller 14, and rotates the cleaning roller 42 in the opposite direction to that of the pressure roller 14. The actuating mechanism 60 includes any suitable well known motor M and linkage system (designated by the numeral 62 in FIG. 2), or by any type of equivalent electrical components. In operation, the actuating mechanism 60 is controlled by a microprocessor-based logic and control unit L to selectively act to cause the cleaning roller 42 to engage the pressure roller 14 only during the fusing of duplex marking particle images. The cleaning roller 42 otherwise is urged to stay disengaged from the pressure roller 14; for example, during a stand-by mode, or during the making of simplex (one-sided) reproductions. Therefore, no additional release oil is applied to the pressure roller 14, which may be carried out with the receiver fuser rollers to contaminate other components of the electrostatographic reproduction apparatus such as the photoconductor, the transfer fuser roller, and chargers for example.

The cleaning apparatus can include a pressure roller-cleaner nip controller associated with the machine controller, for changing a width of said nip between said pressure roller and said cleaner to remove oil from said pressure roller by changing said nip width. This controller can also communicate with the sensor 64 which can be an oil detector. The oil detector is used to determine the presence of oil in an interframe space I such that that the presence of oil can be detected and absorbed by the cleaner before it cause artifacts or other problems. The oil detector in communication with said cleaner and said machine controller to determine when the roller should be changed. The oil absorbent layers having a thickness range for the absorbent material is between 0.200 mm and 0.450 mm.

Distinct embodiments of the invention, the fusing fuser roller may be in the form of a roller, a belt or a sleeve, or variations thereof as are well-known in the art.

The invention confers the advantage of enabling the printer to run jobs in document mode while mixing a variety of receivers, without loss of productivity or fusing quality. The invention also facilitates seamless printing on the widest possible ranges of media types and weights.

There are two options for controlling the timing and magnitude of the cleaning.

The first method establishes the timing by predetermining situations and the appropriate actions, the relevant parameters to handle those situations and storing these in a look-up-table (LUT). These parameters would include timing of the roller rotation relative to when the interframe approaches the nip. Substrate qualification empirically derived settings can also be used to determine in advance the amount of cleaning that is needed for each type of substrate. The timing and amount of the interframe cleaner contact time would them be programmed into the fuser controller. This would be a "blind" control method.

A second method uses one or more sensors that sense the oil contamination. The contamination could be sensed with an oil sensor and a high frequency data acquisition system. Feedback control would then be used to sense the contaminated interframe and direct the appropriate response from the cleaner.

Those skilled in the art understand that the functional elements of the sensor 64 and the controllers 40, 48 may be implemented in different ways. In lieu of actual sensors, the machine may be pre-set for specific media types, weights and toner content. Likewise, the controllers 40, 48 may use electric stopper motors, hydraulics or pneumatic operators and other equivalent means to move the rollers and set the nips.

The invention has been described in detail with particular reference to certain preferred embodiment thereof, but it will be understood that variations and modifications can be effected within the spirit and scope of the invention.

What is claimed is:

1. A method for cleaning a pressure roller in a fusing station of an electrostatographic printer comprising:

fusing toner to sheets of receiver media using a heated fuser roller and a pressure roller comprising a pressure roller surface proximate said heated fuser roller to form a fusing nip there between;

changing fusing nip widths with a machine controller in accordance with the type of receiver media and the image on the media; and cleaning a pressure roller by contacting a cleaner comprising a cleaner surface portion having one or more thin oil absorbent layers in intermittent contact with said pressure roller thus forming a cleaning nip there between, so that the cleaner surface portion presses against said pressure roller surface to deflect the cleaning surface portion at least 0.200 mm.

2. The method of claim 1, said cleaning step occurring when said printer is in a duplex mode.

3. The method of claim 1, wherein said contacting said cleaner surface portion with said pressure roller surface further comprises contacting said cleaner portion to enhance oil absorption by one or more areas of said oil absorbent layers of said cleaner.

4. The method of claim 3, said contacting step controlled by a pressure roller-cleaner controller for controlling said cleaner to remove oil from said pressure roller.

5. The method of claim 4, wherein said cleaner surface portion comprises an array of said one or more oil absorbent layers against said pressure roller surface.

6. The method of claim 4, said cleaning step further comprising varying said pressure roller-cleaner nip width to create a differential nip between said pressure roller and said cleaner in order to remove oil from said pressure roller.

7. The method of claim 1, said cleaner surface portion having oil absorbent layers with a thickness range between 0.200 mm and 0.450 mm.

8. The method of claim 1, further detecting the presence of oil and controlling said pressure roller cleaner based on the results.

9. The method of claim 1, said cleaner surface portion having one or more oil absorbent layers having a thickness range for the absorbent material between 0.200 mm and 0.450 mm.

10. An electrostatographic printer with a roller fusing apparatus comprising:

a heated fuser roller for fusing toner to sheets of receiver media;

a pressure roller comprising a pressure roller surface proximate said heated fuser roller to form a fusing nip there between;

a machine controller for changing fusing nip widths in accordance with the type of receiver media and the image on the media;

a pressure roller cleaner proximate said pressure roller for cleaning said pressure roller surface, said cleaner comprising one or more thin oil absorbent layers in intermittent contact with said pressure roller to form a pressure roller-cleaning nip there between and an oil detector in communication with said cleaner and said machine controller to determine when the roller should be changed.

11. The apparatus of claim 10, said apparatus further comprising a pressure roller-cleaner nip controller associated with said machine controller, for changing a width of said nip between said pressure roller and said cleaner to remove oil from said pressure roller by changing said nip width.

12. The apparatus of claim 11, wherein said pressure roller-cleaning nip width controller is in communication with said machine controller.

13. The apparatus of claim 11, further comprising varying said nip width in relation to an oil detector that is in communication with said cleaner and said controller to determine the presence of oil in an interframe space.

14. The apparatus of claim 10, further comprising an oil detector in communication with said cleaner to determine the presence of oil in an interframe space so that it can be removed by said cleaner.

15. The apparatus of claim 10, said one or more oil absorbent layers comprising about 70% PES (polyethersulfone) and about 30% PA Nylon (Polyamides).

16. The apparatus of claim 10, said one or more oil absorbent layers comprising one or more of polyester and polyester/Nomex blends having less than 100% Nomex materials.

17. The apparatus of claim 10, said oil absorbent layers having a thickness range for the absorbent material is between 0.200 mm and 0.450 mm.

18. A fuser assembly for an electrostatographic reproduction apparatus said fuser assembly comprising:

a fuser roller and a pressure roller locatable in operative association to apply heat and pressure to a marking particle image carried by a receiver to fix such marking particle image to said receiver as said receiver is transported between said fuser roller and pressure roller;

an oil absorption cleaning system proximate said pressure roller for cleaning said pressure roller, said cleaning system comprising: an absorptive portion including one or more thin layers of an oil absorbing material adapted to absorb oil; a drive mechanism associated with said cleaning system for moving said cleaning system relative to said pressure roller such that said absorptive portion is located in operative association with said pressure roller or spaced apart from said pressure roller; and a controller for selectively activating said drive mechanism to selectively move said absorptive portion relative to said pressure roller, wherein said absorptive portion has a thickness range between 0.200 mm and 0.450 mm.

19. The apparatus of claim 18, wherein said absorptive portion comprises 70% PES (polyethersulfone) and 30% PA Nylon (Polyamides).

20. The apparatus of claim 18, wherein said absorptive portion comprise one or more of polyester and polyester/Nomex blends having less than 100% Nomex materials.

21. The apparatus of claim 18, wherein controller for selectively activating said drive mechanism selectively activates said drive mechanism to move said pressure roller cleaner to a proximate location only when said apparatus is in a duplex mode.

* * * * *